US006624123B2

(12) United States Patent
Clement et al.

(10) Patent No.: US 6,624,123 B2
(45) **Date of Patent: *Sep. 23, 2003**

(54) USE OF SURFACTANTS WITH HIGH MOLECULAR WEIGHT FOR IMPROVING THE FILTERABILITY IN HYDRAULIC LUBRICANTS

(75) Inventors: Olivier Pascal Marie Clement, LeHavre (FR); Christophe Le Sausse, Montivilliers (FR); Dominique Batelier, LeHavre (FR); Jacques Cazin, Saint Martin du Manoir (FR)

(73) Assignee: Chevron Chemical S.A., San Francisco, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,224

(22) Filed: Dec. 11, 1998

(65) Prior Publication Data

US 2002/0032127 A1 Mar. 14, 2002

(30) Foreign Application Priority Data

Apr. 11, 1997 (FR) ..... 97 04505
Apr. 2, 1998 (FR) ..... PCT/FR98/00669

(51) Int. Cl.[7] ..... C10M 129/72; C10M 155/04

(52) U.S. Cl. ..... 508/192; 508/291; 508/485; 508/486; 252/77; 252/78.1

(58) Field of Search ..... 508/192, 291, 508/485, 486; 252/77, 78.1

(56) References Cited

U.S. PATENT DOCUMENTS 3,018,291 A * 1/1962 Anderson
3,024,237 A * 3/1962 Drummond et al.
3,172,892 A * 3/1965 Le Suer
3,219,666 A * 11/1965 Norman et al.
3,254,025 A * 5/1966 Le Suer
3,272,746 A * 9/1966 Le Suer et al.
3,331,776 A * 7/1967 Krukziener
3,381,022 A * 4/1968 Le Suer
3,522,179 A * 7/1970 Le Suer
4,234,435 A * 11/1980 Meinhardt et al.
4,417,990 A * 11/1983 Clason et al.
4,612,132 A * 9/1986 Wollenberg et al.
5,840,662 A * 11/1998 Nibert et al. ..... 508/291

FOREIGN PATENT DOCUMENTS

GB 2293389 A * 3/1996
GB 2 293 389 3/1996 ..... C10M/141/10

* cited by examiner

*Primary Examiner*—Margaret Medley
(74) *Attorney, Agent, or Firm*—S. G. K. Lee

(57) ABSTRACT

A hydraulic oil, a predominant amount of an oil having a viscosity suitable for lubrication, and from 0.03% to 0.06% of an agent improving filterability, corresponding to the formula R—Z. Z represents an ester of succinic acid comprising the reaction product of a succinic anhydride and an aliphatic polyhydric alcohol; or a succinimide comprising the reaction product of a succinic anhydride and a polyamine, the said reaction product being treated with an after-treatment agent. R represents a polyolefin having a molecular weight (Mn) of 500 to 2500 and an Mw/Mn ratio of 1 to 5.

8 Claims, No Drawings

USE OF SURFACTANTS WITH HIGH MOLECULAR WEIGHT FOR IMPROVING THE FILTERABILITY IN HYDRAULIC LUBRICANTS

Priority is claimed for this application under 35 U.S.C. §119 based upon PCT/FR98/00669, filed on Apr. 2, 1998 and French application 97/04505 Apr. 11, 1997.

SCOPE OF THE INVENTION

The present invention relates to lubricating fluids having improved filterability characteristics, and to effective additives for improving the filterability characteristics of lubricating fluids such as hydraulic oils. The present invention relates more particularly to lubricating fluids and additives containing an effective quantity of an agent improving filterability which contains at least one polar group consisting in a succinic acid derivative and at least one polyolefinic chain and having a molecular weight (Mn) of about 500 to about 2500.

TECHNOLOGICAL BACKGROUND

Most lubricating oils currently in use, such as hydraulic fluids and similar fluids, contain additives which are designed to confer optimum performances as regards the prevention of wear, protection against rust, demulsibility, thermal stability, stability towards hydrolysis and oxidation stability, air release capacity, and foam prevention. Moreover, hydraulic oils have to exhibit extremely good filterability properties which are measured and evaluated using a certain number of detailed filterability tests such as the AFNOR NFE 48690, 48691 and 48693, CETOP RP 124H, DENISON and PALL tests.

Unfortunately, the formulation scope required to satisfy the principal performance criteria often militates against good filterability because, in general, the use of additives is harmful for filterability. For example, the use of viscosity index (VI) improvers and pour point depressors (PPD) has made it more difficult to formulate oils having a high viscosity index and/or better properties at low temperatures.

The filterability of hydraulic oils is currently an important technical point because it is an important imperative for current and future formulations. Indeed, most hydraulic systems use decontamination filters. The contaminants may be metal particles, dust, lacquers, polymers resulting from oxidation and thermal stability factors. In fact, limiting pollution by hydraulic oils has becoming a deciding factor for obtaining good performances under operating conditions, also including improved wear prevention by reducing abrasive particles. Consequently, the trend is to reduce the porosity of the filters (in line) even further to a value of about 3 micrometers in certain cases.

Consequently, filterability tests in a dry and in a damp medium have been developed for evaluating, and offering means of improving, the filterability performances of hydraulic oils. However, in view of the very fine porosity of the filters used in these bench tests and also because of the presence of water in some of these operating procedures, the performances of hydraulic oils are sometimes lower than the acceptable criteria.

As the presence of water has an adverse effect on the filterability performance of hydraulic oils, most of the bench-scale filterability tests used at present include a period of storage of the oil artificially contaminated with water. The presence of water poses a problem because water undergoes adsorption on the calcium carbonates and calcium hydroxides forming part of the calcium salt detergents which are often present in hydraulic additives. Moreover, water interacts with the ZDDP liberating ZnO. These interactions lead to fine deposits which tend to block the filters.

Various technologies have been used in the past in an attempt to solve these problems. The most commonly used means known to date include the use of metal carboxylates in the manner described in the document GB 2 293 389, reducing the concentrations of ZDDP from about 8 mM/kg of oil to a value equal to or less than about 4 mM/kg of oil, or formulating additives with particular viscosity index improvers which are less harmful for filterability.

SUMMARY OF THE INVENTION

The inventors have discovered that it is possible to improve the filterability properties of lubricating oils by using agents improving filterability containing at least one polar group and at least one polyolefinic chain having a particular length. More interestingly, if the compounds described below are used, the filterability performances are improved but this improvement obtained is not generally harmful for the principal performance criteria and may even have positive effects in certain cases.

The present invention relates in a general manner to a lubricating fluid, particularly a hydraulic oil, comprising:

1) a predominant amount of an oil having a viscosity suitable for lubrication, and
2) from 0.03% to 0.06% of an agent improving filterability, corresponding to the following formula:

R—Z wherein Z represents i) an ester of succinic acid comprising the reaction product of a succinic anhydride and an aliphatic polyhydric alcohol; or
ii) a succinimide comprising the reaction product of a succinic anhydride and a polyamine, the said reaction product being treated with an after-treatment agent; and R represents a polyolefin having a molecular weight (Mn) of 500 to 2500 and an Mw/Mn ratio of 1 to 5.

Examples of after-treatment agents are cyclic carbonates, boric acid and boric acid derivatives.

The present invention also relates to an additive for a lubricating fluid composition. The additive comprises an effective quantity of an agent improving filterability corresponding to the above-mentioned description. The present invention also relates to the use of such compounds for increasing the filterability of oil compositions, particularly hydraulic oils.

Although the additives and compounds of the present invention are particularly useful for increasing the filterability of hydraulic oils, they may also be used for improving the filterability of other types of oil. The present invention is now described in more detail below.

DETAILED DESCRIPTION OF THE INVENTION

The inventors have discovered that two particular categories of compound are useful for improving the filterability properties of lubricating oils. These compounds all prove to have in common a structural characteristic which comprises at least one of the polar groups corresponding to the above-mentioned definition and at least one polyolefinic chain having a particular length.

In order better to demonstrate the structural relationship between the polar group and the polyolefinic chain of the agents improving filterability of the present invention, specific examples of the two preferred groups of compounds and of the reaction substances used to prepare said compounds are set out below.

Reaction Substance Consisting in a Succinic Anhydride

The process for the preparation of succinic anhydrides with alkenyl or alkyl substituents comprising the reaction of a polyolefin and a maleic anhydride has been described in practice.

In the case of the categories of compounds described in the present invention, the alkenyl or alkyl group R has an Mn value of about 500 to about 2500 and an Mw/Mn ratio of about 1 to about 5.

The preferred Mn intervals depend on the chemical nature of the agent improving filterability. Polyolefinic polymers suitable for the reaction with maleic anhydride include polymers containing a predominant quantity of $C_2$ to $C_5$ monoolefins, for example, ethylene, propylene, butylene, isobutylene and pentene.

A highly suitable polyolefinic polymer is polyisobutene.

The succinic anhydride preferred as a reaction substance is PIBSA, that is, polyisobutenyl succinic anhydride.

If the agent improving filterability contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400.

The polyisobutenes having an Mn value of about 2200 are highly suitable.

If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously in a polymerised isobutene having an Mn value of 500 to 1500. In preference, a polymerised isobutene having an Mn value of 850 to 1200 is used.

Reaction Substance Consisting of a Polyhydric Alcohol

A particular category of agents improving filterability comprises the reaction product of a succinic anhydride having an alkenyl or alkyl substituent and an aliphatic polyhydric alcohol.

Examples of aliphatic polyhydric alcohols are glycerol, pentaerythritol and sorbitol.

The aliphatic polyhydric alcohol is preferably pentaerythritol.

Ester of Polyisobutenyl Succinic Acid

The process for the production of esters of polyisobutenyl succinic acid has been described in the U.S. Pat. No. 3,381,022, of America which is cited by way of reference in the present specification.

In a particular embodiment, the polyisobutenyl end of the ester of polyisobutenyl succinic acid has an Mn value of about 850 to about 1200, and the aliphatic polyhydric alcohol is pentaerythritol. The resulting ester consisting of a succinate is an agent improving filterability, designated by the code FE1.

Reaction Substance Consisting of a Polyamine

The polyamine to be reacted with the alkenyl or alkyl succinic anhydride to produce the polyamine-alkenyl or alkyl succinimide is generally a polyalkylene polyamine having an average ratio of the number of nitrogen atoms per molecule from 2 to a maximum of about 12.

Examples of suitable polyamines which may be used include the following: ethylenediamine (EDA), diethylenetriamine (DETA), triethylenetetramine (TETA), tetraethylenepentamine (TEPA), a heavy polyamine (HPA) containing approximately 5 to 7 nitrogen atoms per molecule. Mixtures of the above-mentioned polyamines may also be used.

Suitable polyamines are those having an average ratio of the number of nitrogen atoms per molecule of 2 to about 7. Highly suitable polyamines are those having an average ratio of the number of nitrogen atoms per molecule of about 5 to about 7.

The average ratio of the number of nitrogen atoms per molecule is calculated in the following manner:

$$\text{Average ratio of the number of nitrogen atoms per molecule} = \frac{\%\text{ of N} \times \text{Mpa}}{14 \times 100}$$

in which equation

% of N: percentage of nitrogen in the polyamine or the mixture of polyamines

Mpa: number-average molecular weight of the polyamine or mixture of polyamines.

Polyamino-alkyl or Alkenyl Succinimide

The reaction of the polyamine with an alkenyl or alkyl succinic anhydride to produce polyamino-alkyl or alkenyl succinimides is well known in practice and is described in the U.S. Pat. Nos. 2,992,708; 3,018,291; 3,024,237; 3,100,683; 3,219,666; 3,172,892 and 3,272,746 of America which are cited by way of reference in the present specification in relation to their description of the preparation of alkyl or alkenyl succinimides. Generally, a suitable molar charge of the polyamine to the alkyl or alkenyl succinic anhydride for the production of polyamino-alkyl or alkenyl succinimides is within the interval of about 0.35:1 to about 1:1 but preferably about 0.4:1 to about 0.5:1.1

After-treatment of a Polyamino-alkenyl or Alkyl Succinimide

The polyamino-alkenyl or alkyl succinimides obtained in the manner described above are also caused to react with an after-treatment agent chosen from a cyclic carbonate and boric acid or a boric acid derivative. The preparation of such polyamino-alkenyl or alkyl succinimides having undergone an after-treatment has been described in practice.

Suitable after-treatment agents are cyclic carbonates. A particularly suitable cyclic carbonate is 1,3-dioxolan-2-one (ethylene carbonate). Ethylene carbonate is available commercially or may be prepared by processes well known in practice.

The reaction of polyamino-alkenyl or alkyl succinimides with cyclic carbonates is described in the U.S. Pat. No.

4,612,132 of America which is cited by way of reference in the present specification.

In a particular embodiment, the reaction product of a polyisobutenyl succinic anhydride having a polyisobutenyl end having an Mn value of about 2200 (PIBSA 2200) and an HPA, using a molar charge of HPA or PIBSA 2200 within the interval of about 0.4:1 to about 0.5:1 also underwent an after-treatment with ethylene carbonate. The resulting polyamino-alkenyl succinimide having undergone an after-treatment constituted an agent improving filterability, designated by the code FE2.

The Use of Agents Improving Filterability

The concentration of the agents improving filterability described above must be adjusted in such a way that the desired effect (improvement in the filterability characteristics of the oil) are obtained without any adverse effect on other performances resulting from the action of other additives which may be present in the oil composition. More particularly, it is considered that excessive concentrations of the compounds used in the context of the present invention may, in some cases, have adverse effects, particularly oxidation, a deterioration in thermal stability and hydrolysis of the finished oil.

The exact mechanism of action of the compounds used in the context of the present invention on the improvement in filterability is not fully understood. Without wishing to be bound to any particular theory, the inventors consider that there is no notable interaction in the proper sense of the word between the agents improving filterability and the other compounds present in the lubricating oil.

However, it has become apparent that, in repetitive [sic] interactions taking place between solid particles, polymers (VI improvers, PPD) and the water present in the oil, the surfactant effects of the polar agents improving filterability have a preferential dispersant effect on the solid particles and on certain organic molecules which makes it possible to prevent the formation of aggregates of certain dimensions and, consequently, filter blockages. It has also become apparent that the polar substituents of the agents improving filterability of the present invention give rise to a certain type of inhibition of the harmful effects of viscosity index improvers and pour point depressors, also due to preferential interactions with solid particles and certain organic molecules.

It has also become apparent that there is an important relationship between the polar substituents and the lipophilic chain.

It is possible to determine the choice of polar substituents and lipophilic substances for the preparation of a particular agent improving filterability, in accordance with the present invention, by referring to the calculation of their polar/lipophilic ratio. A suitable method for calculating this ratio was described in the publication of "Atlas Chemical France" entitled "Le système HLB d'ATLAS" [The ATLAS HLB system]. In this document which is cited by way of reference in the present application, the polar/lipophilic ratio is denoted by the hydrophilic/lipophilic balance (HLB).

It is possible to use a mixture of agents improving filterability, although a cumulative effect of the filterability properties is not necessarily observed. However, the inventors consider that complementary and even synergistic effects may occur if a plurality of different agents improving filterability is used in the same formulation. However, it should be borne in mind that the total concentration of the mixture of agents improving filterability should not exceed, notably, the concentrations described previously in order to avoid undesirable secondary effects which might harm the overall properties of the lubricating fluid formulation.

The agents improving filterability of the present invention are particularly useful for improving the filterability characteristics of lubricating oils and, preferably, hydraulic oils. They are effective irrespective of the presence or absence of a viscosity index improver in the oil. The improvement in filterability may be obtained for considerably different viscosity intervals. For example, in hydraulic oils and industrial oils, an improvement in filterability may be obtained for grades ranging from ISO VG 15 to 150, preferably for grades ranging from ISO VG 32 to 68.

For example, the filterability test AFNOR NFE 48691 comprises the following steps:

- formulation of the oil
- incorporation of 0.2.% by weight of water and mixing to form an emulsion
- storage at 70° C. for 72 hours, then storage at ambient temperature (24 hours)
- filtration of 300 ml of oil over a Millipore 0.8 $\mu$m filter at a pressure which depends on the rate of filtration
- measuring the time required to filter 50, 100, 200 and 300 ml of oil and calculating the corresponding IFE values.

In the AFNOR NFE 46891 [sic] tests, the filterability indices calculated for test oils containing agents improving filterability have been substantially improved compared with reference formulations not containing agents improving filterability and, in fact, are close to the "ideal" filterability index which is equal to 1. Moreover, the incorporation of low concentrations of agents improving filterability used in the present invention in additives does not generally prove to be harmful for other properties such as wear prevention, resistance to oxidation or thermal stability or the resistance to hydrolysis of hydraulic oils. This was measured using tests such as the FZG seizing test, the Denison and Vickers Vane tests, and tests on piston pumps and the Cincinnati Milacron thermal stability tests and the ASTM D 943 and ASTM D 4310 oxidation tests and the ASTM D 2619 stability towards hydrolysis test. In the manner mentioned above, it was also noted that some of these agents improving filterability may have an advantageous effect on the thermal stability and the performance in terms of resistance to oxidation.

The skilled person wishing to use the teachings of the present invention to prepare appropriate lubricating fluids may carry out this preparation using basic oils and additives currently available. Information concerning these other constituents is set out briefly below.

Basic Lubricant

The basic lubricant may be chosen from hydraulic/transmission fluids, hydraulic brake fluids, fluids for power steering and fluids for tractors, the exact composition of which may vary slightly. The lubricating oils of the present invention contain a predominant amount of an oil having a viscosity suitable for lubrication. Said oil may be any lubricating oil based on hydrocarbons, or a basic synthetic lubricating oil. It may be derived from synthetic or natural sources and it may consist in a paraffinic, naphthenic or asphaltic basic oil or a mixture thereof.

In one embodiment, the oil having a viscosity suitable for lubrication is prepared from a crude mineral oil by physical separation processes such as distillation, deasphalting and dewaxing, or it may be prepared by a chemical conversion such as a catalytic or non-catalytic hydrotreatment of mineral oil fractions, or by a combination of physical separation processes and a chemical conversion; or it may consist in a basic synthetic hydrocarbon oil. Preferably, the oil having a viscosity suitable for lubrication has a kinematic viscosity of 5 to 220 cSt at 40° C.

Other Additives

Other additives which are well known in practice may be present in the hydraulic fluid with improved filterability of the present invention. These additives may include, for example, antioxidants, viscosity index improvers, detergents, anti-rust agents, demulsifying agents, foam inhibitors, corrosion inhibitors, pour point depressors, and other anti-wear agents. Examples of said additives are given below:

Antioxidants: include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di(alkylphenyl) amines; and alkylated phenylene-diamines.

Viscosity index improvers: include polymeric alkylmethacrylates and olefinic copolymers such as an ethylene-propylene copolymer or a styrene-butadiene copolymer.

Detergents: include calcium alkylsalicylates, calcium alkylphenates and calcium alkarylsulfonates.

Anti-rust additives: include (short-chain) alkenyl succinic acids, partial esters thereof and nitrogen-containing derivatives thereof; and synthetic alkarylsulfonates, such as metal dinonylnaphthalene sulfonates.

Demulsifying agents: include alkoxylated phenols and phenol-formaldehyde resins and synthetic alkylaryl sulfonates such as metallic dinonylnaphthalene sulfonates.

Foam inhibitors: include polymers of alkyl methacrylate and polymers of dimethylsilicone.

Corrosion inhibitors: include 2,5-dimercapto-1,3,4-thiadiazoles and derivatives thereof, mercaptobenzothiazoles, alkyltriazoles and benzotriazoles.

Pour point depressors (PPD): include polymethacrylates.

Anti-wear agents: zinc alkyldithiophosphates (preferred), aryl phosphates and phosphites, sulfur-containing esters, phosphosulfur compounds, and metal or ash-free dithiocarbamates.

The hydraulic fluid with improved filterability of the present invention may be produced by mixing the oil having a viscosity suitable for lubrication and the agent improving filterability together with the other additives described above optionally present in the oil having a viscosity suitable for lubrication. The constituents of this mixture may interact during the mixing operation, modifying the agent improving filterability and/or the other additives.

The various preferred conditions indicated above apply both to the lubricating fluids and to the process for the production of a hydraulic fluid and to the uses according to the present invention.

The present invention is illustrated in more detail by the following examples which are proposed by way of illustration of the present invention. They are not intended to limit its scope.

EXAMPLES

Basic Formulation of Additives: a basic formulation of additives comprising functional quantities of zinc dithiophosphate, an ash-free dithiocarbamate, a detergent containing calcium, a phenolic antioxidant, anti-rust additives, demulsifying agents, a foam inhibitor based on a silicone polymer, was produced by mixing in such a way that the basic formulation of additives (XOIE 303J) represents 0.80% by weight of the finished oil formulation. The finished oil formulation had a kinematic viscosity at 40° C. equal to about 46 cSt.

Agents Improving Filterability Tested: The two agents improving filterability FE1 and FE2 described above were tested according to the operating procedure in the following examples:

Comparative Example A

The basic formulation of additives was mixed in a refined basic oil with a solvent "A" with the addition of a PPD (of the PMA type) in a quantity of 0.2% by weight.

Example 1

A quantity of 0.05% by weight of FE1 was added to the finished oil in comparative example A.

Example 2

A quantity of 0.05% by weight of FE2 was added to the finished oil of comparative example A.

Comparative Example B

The basic formulation of additives was mixed in a refined basic oil with a solvent "B" with the addition of a PPD (of the PMA type) in a quantity of 0.2% by weight.

Example 3

A quantity of 0.05% by weight of FE1 was added to the finished oil of comparative example A.

Comparative Example C

The basic formulation of additives was mixed in a refined basic oil with a solvent "C" with the addition of a PPD (of the PMA type) in a quantity of 0.2% by weight with the addition of a VI improver (of the PMA type) in a quantity of 4.65% by weight.

Example 4

A quantity of 0.05% by weight of FE1 was added to the finished oil of comparative example C.

Comparative Example D

The basic formulation of additives was mixed in a "basic formulation speciality" "D" containing a certain quantity of VI improver (of the PMA type).

Example 5

A quantity of 0.05% by weight of FE1 was added to the finished oil of comparative example D.

The above-mentioned examples were evaluated in the filterability tests AFNOR NFE 48690 (A, B, C, D) and AFNOR NFE 48691 (A, B).

Table 1 below summarises the test results.

TABLE 1

Filterability tests on formulations HM and HV of grade ISO VG 46 (filterability indices IF and IFE)

| Filterability tests | AFNOR NFE | 48690 | 48690 | 48691 | 48691 | 48690 | 48690 |
|---|---|---|---|---|---|---|---|
| Type of oil | | HM | HM | HM | HM | HV | HV |
| Basic oils | | A | B | A | B | C | D |
| Grade | ISO | VG 46 | VG 46 | VG 46 | VG 46 | VG 46 | VG 46 |
| Constituents | Amounts (wt. %) | | | | | | |
| Reference additive | XOIE 303 J (0.8 wt. %) | 1.58 | 8.1 | 1.68 | 3.2 | 1.32 | 1.28 |
| FE1 | 0.05 | 1.05 | 1.14 | 1.24 | 1.24 | 1.23 | 1.14 |
| FE2 | 0.05 | 1.02 | — | — | — | — | — |

Comparative Examples E and F

In this example, tests were carried out to evaluate the optimum concentration of FE1 in filterability tests using two different basic oils.

Comparative Example E

The basic formulation of additives was mixed in a refined basic oil with a solvent "B" with the addition of a PPD (of the PMA type) in a quantity of 0.2% by weight.

Example 6

A quantity of 0.01% by weight of FE1 was added to the finished oil of comparative example E.

Example 7

A quantity of 0.03% by weight of FE1 was added to the finished oil of comparative example E.

Example 8

A quantity of 0.05% by weight of FE1 was added to the finished oil of comparative example E.

Comparative Example F

The basic formulation of additives was mixed in a "basic formulation speciality" "D" containing a certain quantity of VI improver (of the PMA type).

Example 9

A quantity of 0.01% by weight of FE1 was added to the finished oil of comparative example F.

Example 10

A quantity of 0.03% by weight of FE1 was added to the finished oil of comparative example F.

Example 11

A quantity of 0.05% by weight of FE1 was added to the finished oil of comparative example F.

The above-mentioned examples were evaluated in the filterability tests AFNOR NFE 48690 (B, D) and AFNOR NFE 48691 (B, D).

Table 2 below summarises the test results. The results show that, although the concentrations of FE1 may vary within the interval from 0.01 to 0.05%, improved filterability indices of the finished oils are obtained, optimum results being obtained when the concentration is equal to 0.05%.

TABLE 2

Evaluations of filterability for various concentrations of agents improving filterability (filterability indices IF and IFE)

| FE concentration in oil | AFNOR NFE test | Basic oil (B) | Basic oil (D) |
|---|---|---|---|
| 0% (XOIE 303 J (0.8% by wt.) | 48690 | 8.1 | 1.71 |
| | 48691 | 3.2 | 1.68 |
| 0.01% of FE1 | 48690 | 1.17 | 1.25 |
| | 48691 | 1.33 | — |
| 0.03% of FE1 | 48690 | 1.15 | 1.22 |
| | 48691 | 1.21 | — |
| 0.05% of FE1 | 48690 | 1.12 | 1.12 |
| | 48691 | 1.19 | — |

What is claimed is:

1. A hydraulic fluid comprising:

1) a predominant amount of an hydraulic oil having a viscosity suitable for lubrication; and 2) from 0.03% to 0.06% by weight in the hydraulic fluid of an agent improving filterability, corresponding to the following formula:

R—Z wherein Z represents i) an ester of succinic acid comprising the reaction product of a succinic anhydride and an aliphatic polyhydric alcohol; or ii) a succinimide comprising the reaction product of a succinic anhydride and a polyamine, the said reaction product being after treated with a cyclic carbonate or boric acid; and R represents a polyisobutene having a molecular weight (Mn) of 500 to 2500 and an Mw/Mn ratio of 1 to 5.

2. A hydraulic fluid according to claim 1, wherein R has an Mn value of 850 to 1200 and Z represent an ester of succinic acid comprising the reaction product of a succinic anhydride and an aliphatic polyhydric alcohol.

3. A hydraulic according to claim 1, wherein R has an Mn value of 2100 to 2400 and Z represents a succinimide comprising the reaction product of succinic anhydride and a polyamine.

4. A hydraulic fluid according to claim 2, wherein Z represents an ester of succinic acid comprising the reaction product of a succinic anhydride and pentaerythritol.

5. A hydraulic fluid according to claim 3, wherein Z represents a succinimide comprising the reaction product of a succinic anhydride and a polyalkylene polyamine having an average ration of the number of nitrogen atoms per molecule greater than 4 the said reaction product undergoing an after-treatment with a cyclic carbonate.

6. A process for the production of a hydraulic fluid having an increased filterability, which comprises mixing the following constituents:

a) a predominant amount of an hydraulic oil having a viscosity suitable for lubrication, and b) from 0.03% to 0.06% by weight in the hydraulic fluid of an agent improving filterability, corresponding to the following formula:

R—Z wherein Z represents:

i) an ester of succinic acid comprising the reaction product of succinic anhydride and an aliphatic polyhydric alcohol; or ii) a succinimide comprising the reaction product of succinic anhydride and a polyamine, the said reaction product being after-treated with a cyclic carbonate or boric acid hydraulic; and R represents a polyisobutene having a molecular weight (Mn) of 500 to 2500 and an Mw/Mn ratio of 1 to 5.

7. A method for increasing the filterability of a hydraulic fluid, said method comprising adding to the hydraulic fluid from 003% to 0.06% of by weight in the hydraulic fluid an agent improving filterability, corresponding to the following formula:

R—Z wherein Z represents (ii) an ester of succinic acid comprising the reaction product of succinic anhydride and an aliphatic polyhydric alcohol; or (ii) a succinimide comprising the reaction product of succinic anhydride and a polyamine, the said reaction product being after-treated with a cyclic carbonate or boric acid; and R represents a polyisobutene having a molecular weight (Mn) of 500 to 2600 and an Mw/Mn ration of 1 to 5.

8. A hydraulic fluid consisting essentially of:

1) a predominant amount of an hydraulic oil having a viscosity suitable for lubrication;

2) from 0.03% to 0.06% by weight in the hydraulic fluid of an agent improving filterability, corresponding to the following formula:

R—Z wherein Z represents i) an ester of succinic acid comprising the reaction product of a succinic anhydride and an aliphatic polydric alcohol; or ii) a succinimide comprising the reaction product of a succinic anhydride and a polyamine, the said reaction product being after treater with a cyclic carbonate or boric acid; and R represents a polyisobutene having a molecular weight (Mn) of 500 to 2500 and an Mw/Mn ratio of 1 to 5; and 3) at least one additive selected from the group consisting of antioxidants, viscosity index improvers, detergents, anti-rust additives, demulsifying agents, foam inhibitors, corrosion inhibitors, pour point depressors and anti-wear agents consisting essentially of zinc alkyldithiophosphates, aryl phosphates and phosphites, sulfur-containing esters, phosphosulfur compounds, and metal or ash-free dithiocarbamates.

* * * * *